US009890686B2

(12) United States Patent
Klippert et al.

(10) Patent No.: US 9,890,686 B2
(45) Date of Patent: Feb. 13, 2018

(54) ELECTROMOTIVE COOLANT PUMP

(71) Applicant: BROSE FAHRZEUGTEILE GMBH & CO. KOMMANDITGESELLSCHAFT, WUERZBURG, Wuerzburg (DE)

(72) Inventors: Uwe Klippert, Oberaula (DE); Christoph Otto, Wiesenfeld (DE)

(73) Assignee: Brose Fahrzeugteile GmbH & Co. Kommanditgesellschaft, Wuerzburg, Wuerzberg (DE)

( * ) Notice: Subject to any disclaimer, the term of this patent is extended or adjusted under 35 U.S.C. 154(b) by 78 days.

(21) Appl. No.: 15/155,730

(22) Filed: May 16, 2016

(65) Prior Publication Data

US 2016/0258340 A1 Sep. 8, 2016

Related U.S. Application Data

(63) Continuation of application No. PCT/EP2014/002944, filed on Nov. 4, 2014.

(30) Foreign Application Priority Data

Nov. 16, 2013 (DE) ..... 10 2013 019 298
Nov. 16, 2013 (DE) ..... 10 2013 019 299

(51) Int. Cl.

| | |
|---|---|
| ***F01P 5/10*** | (2006.01) |
| ***F04D 15/00*** | (2006.01) |
| ***F04D 29/22*** | (2006.01) |
| ***F01P 7/14*** | (2006.01) |
| ***F04D 1/00*** | (2006.01) |

(Continued)

(52) U.S. Cl.

CPC *F01P 7/14* (2013.01); *F01P 5/10* (2013.01); *F01P 5/12* (2013.01); *F04D 1/00* (2013.01); *F04D 15/0011* (2013.01); *F04D 15/0016* (2013.01); *F04D 29/22* (2013.01);

(Continued)

(58) Field of Classification Search

CPC ..... F01P 7/14; F01P 5/12; F01P 5/10; F04D 15/0011; F04D 29/22; F04D 29/4293; F04D 15/0016; F04D 1/00

See application file for complete search history.

(56) References Cited

U.S. PATENT DOCUMENTS 6,257,177 B1 * 7/2001 Lehmann ..... F01P 5/10 123/41.41
6,920,846 B2 7/2005 Pawellek et al.

(Continued)

FOREIGN PATENT DOCUMENTS

CN 101253314 8/2008
CN 102149923 8/2011

(Continued)

*Primary Examiner* — Jacob Amick

(74) *Attorney, Agent, or Firm* — Laurence A. Greenberg; Werner H. Stemer; Ralph E. Locher

(57) ABSTRACT

An electrically motorized coolant pump includes a pump housing, a pump impeller being driven in a pump chamber, two suction-side intake ducts and a pressure-side outflow duct for the coolant. A control actuator that can be hydraulically actuated in response to a demand for coolant is disposed in a housing section of the pump housing between the suction side and the pressure side and the control actuator is coupled to a control element so as to open and close the intake ducts.

11 Claims, 9 Drawing Sheets

(51) Int. Cl.
*F04D 29/42* (2006.01)
*F01P 5/12* (2006.01)

(52) U.S. Cl.
CPC .... *F04D 29/4293* (2013.01); *F01P 2005/125* (2013.01); *F01P 2007/146* (2013.01)

(56) References Cited

U.S. PATENT DOCUMENTS

| | | | | |
|---|---|---|---|---|
| 7,334,543 | B2 | 2/2008 | Pawellek | |
| 2002/0073942 | A1 | 6/2002 | Hollis | |
| 2004/0237912 | A1* | 12/2004 | Pawellek | F01P 5/10 123/41.44 |
| 2006/0216166 | A1* | 9/2006 | Pawellek | F01P 5/10 417/371 |
| 2008/0216775 | A1 | 9/2008 | Repple et al. | |
| 2011/0162597 | A1 | 7/2011 | Draheim et al. | |
| 2012/0204818 | A1 | 8/2012 | Welte et al. | |

FOREIGN PATENT DOCUMENTS

| | | | |
|---|---|---|---|
| CN | 102635556 | | 8/2012 |
| DE | 3435833 | A1 | 4/1986 |
| DE | 4438705 | A1 | 5/1996 |
| DE | 19755042 | A1 | 6/1999 |
| DE | 19809123 | A1 | 9/1999 |
| DE | 19943981 | A1 | 3/2001 |
| DE | 10207653 | C1 | 9/2003 |
| DE | 10314526 | A1 | 10/2004 |
| DE | 102005057712 | A1 | 8/2006 |
| WO | 03036145 | A1 | 5/2003 |

* cited by examiner

ELECTROMOTIVE COOLANT PUMP

CROSS-REFERENCE TO RELATED APPLICATION

This is a continuation, under 35 U.S.C. § 120, of copending International Application PCT/EP2014/002944, filed Nov. 4, 2014, which designated the United States; this application also claims the priority, under 35 U.S.C. § 119, of German Patent Application DE 10 2013 019 298.6, filed Nov. 16, 2013 and German Patent Application DE 10 2013 019 299.4, filed Nov. 16, 2013; the prior applications are herewith incorporated by reference in their entirety.

BACKGROUND OF THE INVENTION

Field of the Invention

The invention relates to an electrically motorized coolant pump having a pump housing, a pump impeller driven in a pump chamber, two suction-side intake ducts and a pressure-side outflow duct for the coolant. The term "coolant pump" is understood in this case to mean, in particular, an electrical radial or centrifugal pump for the coolant circulation of an internal combustion engine (combustion engine) of a motor vehicle.

Usually a coolant or water-circulating pump is used so as to convey the coolant in the coolant circulation of an internal combustion engine and the pump can be controlled by way of a directional control valve if, in addition to a cooling element circuit that leads by way of a cooling element, a bypass or bypass flow circuit is also provided that, by bypassing the cooling element, leads directly by way of corresponding ducts to the internal combustion engine or to the cylinder head or engine block, which are to be cooled, of the internal combustion engine. The coolant pump is usually driven in an electric manner by using an electric motor that drives a motor or a pump axle with a pump impeller that is disposed in a pump chamber of the pump housing, by way of example in the form of a helical duct.

In the case of coolant pumps that are known from German Patent Application DE 10 2005 057 712 A1 and German Patent Application DE 198 09 123 A1, corresponding to U.S. Pat. No. 6,257,177, and have a pump impeller that is driven by an electric motor, the pump housing includes, in addition to an intake connecting piece for the coolant, which is guided by way of the cooling element, and to an outflow or pressure connecting piece, a bypass or bypass flow connecting piece for the coolant that is not guided by way of the cooling element. The intake connecting piece and the outflow connecting piece are usually used as an interface for attaching cooling hoses so as to produce a closed cooling element circuit or bypass flow circuit (bypass circuit).

In accordance with German Patent DE 102 07 653 C1, corresponding to U.S. Pat. No. 6,920,846, the function of switching a directional control valve that is disposed in the pump intake duct can be performed in conjunction with a rotary slider that can be switched between two positions by using the electrical pump motor. The valve function can also be controlled in accordance with German Patent DE 103 14 526 B4, corresponding to U.S. Pat. No. 7,334,543, by way of a thermostat having a temperature-dependent expansion material element in the form of a so-called wax cartridge.

SUMMARY OF THE INVENTION

It is accordingly an object of the invention to provide a suitable electromotive coolant pump, which overcomes the hereinafore-mentioned disadvantages of the heretofore-known pumps of this general type, which is preferably as compact as possible and is especially simple in particular with regard to its construction and the manufacturing technology required. Furthermore, leakages from the water pump are to be reliably avoided. Moreover, it is to be possible to control or actuate the water pump in a particularly simple and reliable manner.

With the foregoing and other objects in view there is provided, in accordance with the invention, an electrically motorized coolant pump, comprising a suction side, two suction-side intake ducts, a pressure side, a pressure-side outflow duct for a coolant, a pump housing having a housing section, a pump chamber, a pump impeller being driven in the pump chamber, a control actuator disposed in the housing section between the suction side and the pressure side and being hydraulically actuated in response to a demand for coolant, and a control element coupled to the control actuator to open and close the intake ducts. The control actuator has a diaphragm disposed in the pump housing in a coolant-tight manner and/or a control piston. The membrane or control piston is connected or coupled to the control element.

For this purpose, the coolant pump includes a pump housing having a pump impeller, which is disposed in a pump chamber and is driven by using an electric motor and also two suction-side intake ducts and a pressure-side outflow duct for the coolant. The pump housing is embodied in an appropriate manner at least substantially from the motor housing, if necessary having a separate electronics housing for the motor drive, and a housing section, which is embodied preferably as a separate housing part (intermediate housing part), and also a pump cover. The housing parts can, for example, be screwed to one another and consequently can be connected in a detachable manner.

The intake ducts issue or open in an expedient manner jointly into a central inflow duct that is provided within the pump housing in the region of the housing section and is preferably formed at that site by a cylindrical housing periphery. It is preferred that a bypass flow connecting piece issues or opens on the cover side into a first of the intake ducts so as to connect to a bypass flow circuit that does not include a cooling element and is also referred to below as a small cooling element circuit, and an intake connecting piece issues or opens into the second intake duct so as to connect to a cooling element circuit of the coolant circulation of the motor vehicle, the cooling element circuit also being referred to below as a large cooling circuit.

A control actuator that is actuated in a hydraulic manner in response to a demand for coolant is disposed inside the housing section of the pump housing between the suction side and the pressure side and the control actuator is coupled to a control element so as to open and close the intake ducts. The control actuator is actuated, in other words energy is transmitted to the control actuator and by way of this to the control element so as to open or close the intake ducts in a controlled manner, by virtue of the flow behavior of the coolant itself. The flow direction of the coolant to the control actuator in order to actuate the control actuator is determined by using the pressure difference between the pressure side and the suction side. Consequently, it is not necessary to provide any additional energy source nor to provide a thermostat or the like in order to perform the switching function of the coolant pump, at least with respect to a substantial basic function of switching over from an initially open intake duct to the other intake duct, in particular from the small cooling circuit to the large cooling circuit.

The control actuator is embodied as a type of diaphragm and/or piston and is disposed in an appropriate axially displaceable manner in the housing section of the pump housing. This renders it possible to achieve the best possible symmetry and a particularly compact construction of the coolant pump while simultaneously integrating the actuator function with respect to the pump control into the pump housing.

The control actuator is embodied in an appropriate manner by using a diaphragm, which is disposed in the housing section, and a control piston (working piston or reciprocating piston) that is preferably fixedly connected to the diaphragm, the control piston being disposed—with regard to the pump or motor axle—in such a manner that together with the diaphragm it is axially moveable above the pump impeller and the control piston is sealed with respect to the pump housing. A collar-type, elastic silicone roll diaphragm, which on one hand ensures a sealing effect and on the other hand is sufficiently flexible or elastic so as to be able to follow the stroke of the control piston is suitable for this purpose. The diaphragm extends inside the housing section over the housing cross-section so as to separate the suction side from the pressure side.

The control actuator is connected upstream in a starting position (idle position) preferably by using a restoring element, appropriately in the form of a helical spring. In this starting position, a first of the intake ducts namely appropriately the bypass flow for the small cooling circuit is open and the second intake duct, in other words the large cooling circuit, is closed. As the coolant pump is started up and in response to the control actuator being hydraulically actuated, the control element closes the first intake duct (small bypass flow circuit) against the force of the restoring element, also referred to below as a restoring spring (preferably compression spring), and the control element opens the second intake duct (large cooling circuit).

In a particularly advantageous embodiment, the housing section provides a closable actuator chamber (working space) that is connected to the pump chamber by way of a (first) pressure opening. This (first) pressure opening can be closed in an expedient manner by using a (first) electrically controllable control valve in the form of a solenoid valve. In other words, this actuator chamber or this working chamber is connected to the pump chamber and consequently to the pressure side of the coolant pump so as to hydraulically actuate the control actuator by way of the pressure opening, so that the pressure of the coolant in the actuator chamber is practically identical to the pressure in the pressure-side pump chamber.

The control or solenoid valve is therefore preferably open in the non-energized state. As a result, it is ensured that, as the coolant pump is started up, the control actuator is always actuated in the direction in which the large cooling circuit is reliably opened, whereas the control valve is energetically inactive. If, on the other hand, this valve is controlled (energized), then it closes the pressure opening with the result that the influence of hydraulic pressure on the control actuator is interrupted and as a result of the restoring force of the restoring spring the intake duct that corresponds to the small cooling circuit remains open. It is also possible by switching off the coolant pump to return the control actuator into the starting or idle position with the open (small) bypass flow circuit and closed (large) cooling element circuit. The control actuator can be controlled by the hydraulic pressure and by way of example the motor or pump rotational speed can also be controlled accordingly so that it is not absolutely necessary to provide a control valve.

The central inflow duct that is formed in an advantageous embodiment by a cylindrical housing periphery of the housing section issues or opens on the suction side by way of the control element into the intake ducts and on the pressure side into the pump chamber towards the pump impeller. The control actuator, which therefore encompasses the inflow duct expediently in an annular manner, extends in a radial manner with regard to the pump or motor axle in the housing section and thus in the pump housing. In the case of the embodiment that includes a diaphragm and control piston, the diaphragm and control piston are thus likewise embodied in an annular manner, wherein the diaphragm (annular diaphragm) that extends in a radial manner seals the actuator chamber on one hand with respect to the outer wall and on the other hand with respect to the inflow duct or the corresponding cylindrical housing periphery of the housing.

In the corresponding embodiment, the annular diaphragm is therefore guided on the outer periphery side in an expedient manner between a flange-like connection of the intermediate housing part, which forms the housing section, and the pump cover and the annular diaphragm is clamped at that site in a sealing manner. The annular diaphragm is appropriately folded as a type of labyrinth seal in the central, inner region so as to achieve a reliable sealing effect with respect to the central, axially extending inflow duct that is preferably formed by the intermediate housing part. In this preferred embodiment, the annular diaphragm supports the annular control piston (annular piston or annular actuator).

In an advantageous further development of the embodiment of the coolant pump having a controllable control valve, the pump chamber is connected to the inflow duct by way of a (second) closed pressure opening that can be actuated by using a (second) electrically controllable control or solenoid valve that is preferably closed in the non-energized state. This valve is therefore likewise quasi always inactive and in so doing similar to the first valve fundamentally not energized. If this second valve is controlled by using a corresponding electrical signal and thus energized, then the previously closed pressure opening is opened with the result that an at least specific pressure compensation between the pressure side and the suction side of the coolant pump is performed by virtue of correspondingly energizing the valve.

This second control valve that is preferably closed in the non-energized state is thus used in particular so as to open and to close in a controlled manner a connection of the suction-side inflow duct to the pressure side of the pump chamber. As a result and in particular in conjunction with a corresponding control process, in other words controlled energizing of the first control valve, the travel of the control actuator is influenced and thus also the position of the control element. This renders it possible for the control element to move towards practically any desired intermediate positions with the two intake ducts being in different open or closed positions which during the proper operation renders it possible in a particularly simple and reliable manner that requires little energy to achieve practically any mixture of comparatively cool and hot coolant from the two cooling circuits (bypass flow circuit and cooling element circuit or in other words small and large cooling element circuit).

The control element can be rigidly connected, in other words fixedly connected, to the control actuator or can be coupled thereto by way of a control gear. In the case of the coupling variant, it is expediently provided that a pivotable control flap according to a type of helmet visor is disposed between the intake ducts, in other words between the intake connecting piece and the bypass flow connecting piece, the control flap or helmet visor being coupled to the control actuator, which is inside the housing, in particular the control piston of the actuator, by way of a deflecting gear, by way of example in the form of a toothed rack and a toothed gear that meshes with the toothed rack. In this embodiment, the control actuator is embodied so as, in response to a controllable change in pressure as a result of hydraulic actuation, to pivot the control flap between an open position of one intake duct and a closed position of the other intake duct, wherein practically any desired intermediate positions of the control flap are possible between the respective end positions.

In the case of the preferred, rigid variant, an annular slider in the form of a cylindrical sleeve is provided as the control element and the annular slider or sleeve is connected by way of example by support piece-like formed parts preferably to the control piston. In so doing, the annular slider is expediently disposed axially above the cylindrical housing periphery of the intermediate housing part, the cylindrical housing periphery forming with the central inflow duct and the annular slider being disposed in a manner flush with the housing periphery. In other words, the annular slider forms quasi an axial extension or protrusion of the central cylindrical housing periphery and therefore has at least almost the identical cross-section as the cylindrical housing periphery or as the inflow duct that is formed thereby. Outwardly bent collar-like contours that are advantageously formed as one piece on the annular slider and/or on this housing periphery increase the safety and reliability of the contact between the annular slider and the housing periphery that is lying flush with the annular slider and if necessary also increase the sealing tightness of the inflow duct in the corresponding contact position of the annular slider on the housing periphery.

In the position that is created as a result of the control actuator being hydraulically actuated and in which the annular slider is raised axially from the housing periphery against the restoring force of the spring, an adjustable intermediate gap with respect to the housing periphery is created—if necessary in dependence upon the control valves being energized and/or the pump rotational speed. As a consequence, a connection is produced between the corresponding intake duct and the central inflow duct, whereas the annular slider simultaneously completely or in part closes the other intake duct, in other words its connection to the central inflow duct.

When the coolant pump that is incorporated in the coolant circulation of an internal combustion engine of a motor vehicle is in the idle position, the coolant pump holds open a small cooling circuit while bypassing the cooling element. If the coolant pump is started up, then as a result of the build-up of pressure in the actuator chamber caused during the operation, the control actuator is axially displaced and as a result of the control actuator being coupled to the control element it is actuated so that the intake duct that is effective as a bypass flow duct is closed and the other intake duct is opened. As a consequence, a switch occurs from the small cooling circuit to the large cooling circuit and the coolant is guided through the cooling element. In other words, as the coolant pump is started up, the control actuator is actuated in a hydraulic manner and in fact is moved from a starting position in which the bypass flow circuit is at least in part open and the cooling element circuit is at least in part closed into an operating position in which the small cooling element circuit is open and the bypass flow circuit is closed.

It is rendered possible by controlling the first control or solenoid valve to maintain the starting position of the coolant pump in which the small cooling circuit is open, in that a sufficient build-up of pressure in the actuator chamber is impeded and the coolant pump cannot open the large cooling circuit. The (second) control valve (restoring valve) that is appropriately to be controlled in an inverse manner with respect to the first control valve fulfills, in addition to a comfortable mixing valve function, preferably an emergency function in the event that the first control valve does not return as a result of a malfunction.

The control valves are preferably likewise disposed in or on the intermediate housing part. The control valves are controlled in an appropriate manner by way of connection contacts on the outer face of the housing. By virtue of the fact that the control valves, preferably including the electrical or electromagnetic control valves, are integrated in the pump housing, the control actuator has a particularly effective, simple and space-saving construction and also a coolant pump is provided that functions in a reliably leak-proof manner, operates in a reliable manner, has a long serviceable life and fulfills the function of a controllable coolant controller without requiring a thermostat, complex directional control valve configurations, additional pumps, pump attachment parts or control devices, by way of example in the form of a pneumatic controller.

Other features which are considered as characteristic for the invention are set forth in the appended claims.

Although the invention is illustrated and described herein as embodied in an electromotive coolant pump, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
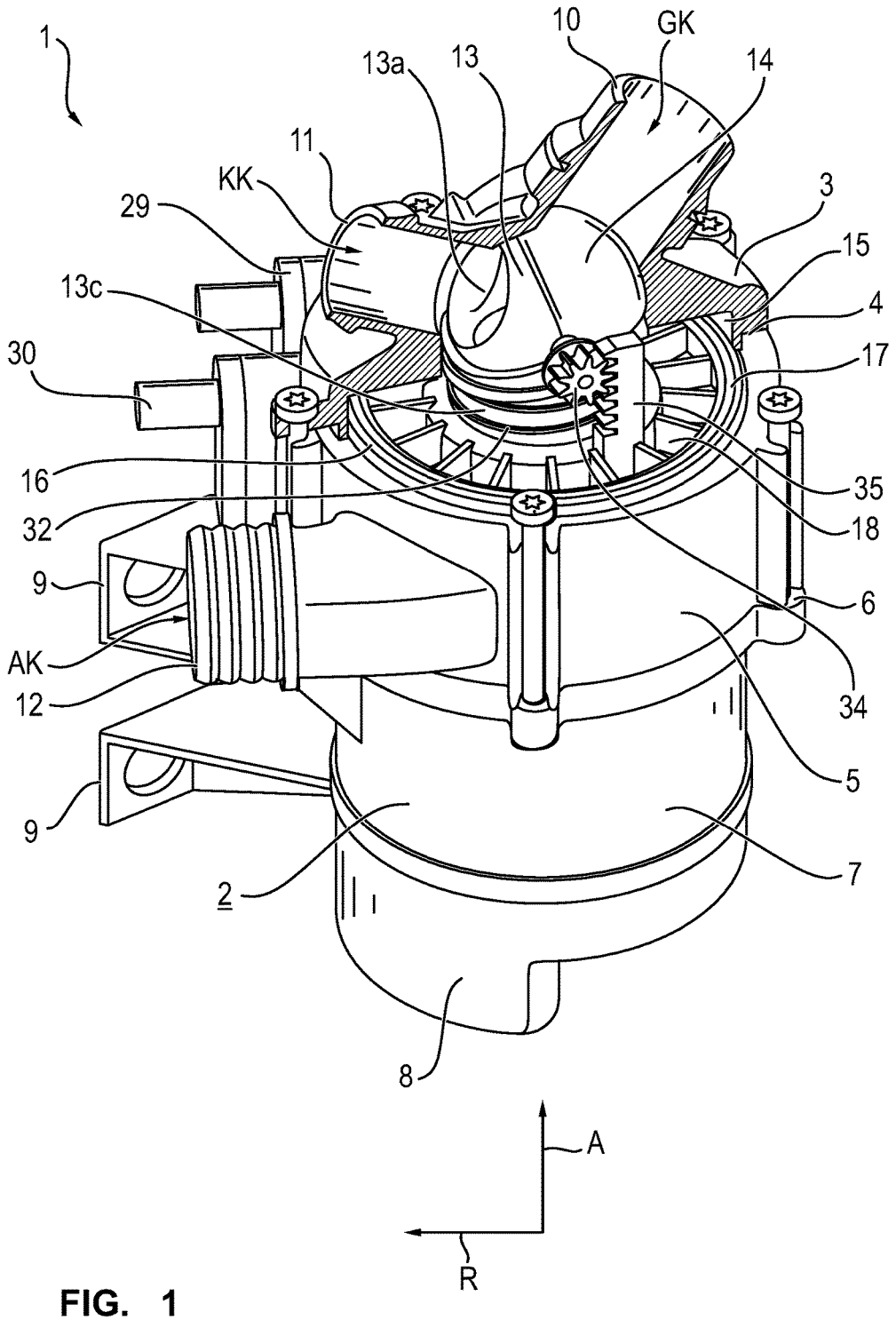
FIG. 1 is a diagrammatic, perspective, partly cut-away view of an electrical coolant pump having a control element in the form of a helmet visor-type control flap between an intake connecting piece and a bypass flow connecting piece, the control element being coupled above a motor housing of an electric motor inside the housing to a control actuator.
Figure 2:
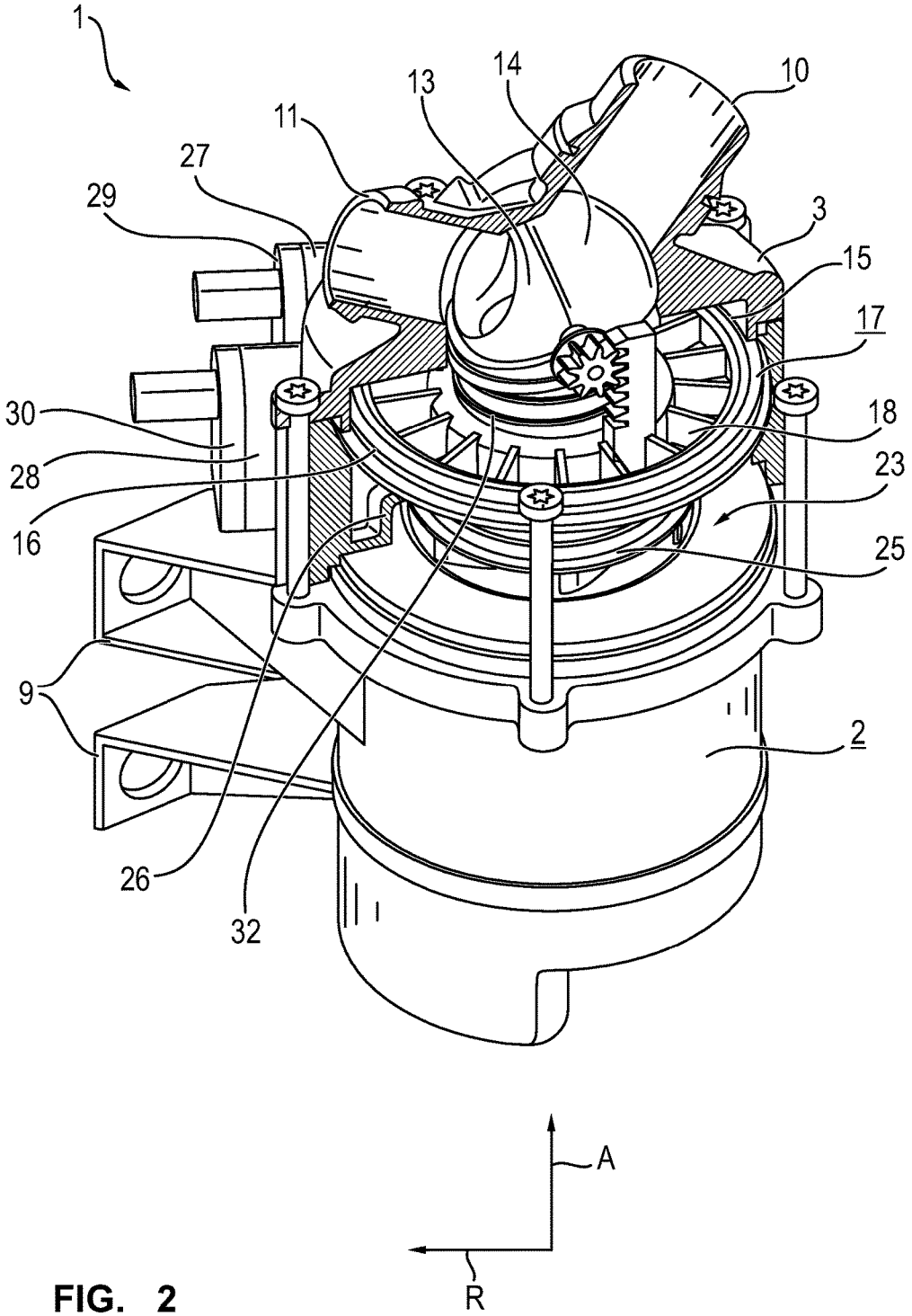
FIG. 2 is to a great extent a partial-sectional view of the coolant pump in accordance with FIG. 1 with a suction-side view of the control actuator and a pressure-side pump impeller.
Figure 4:
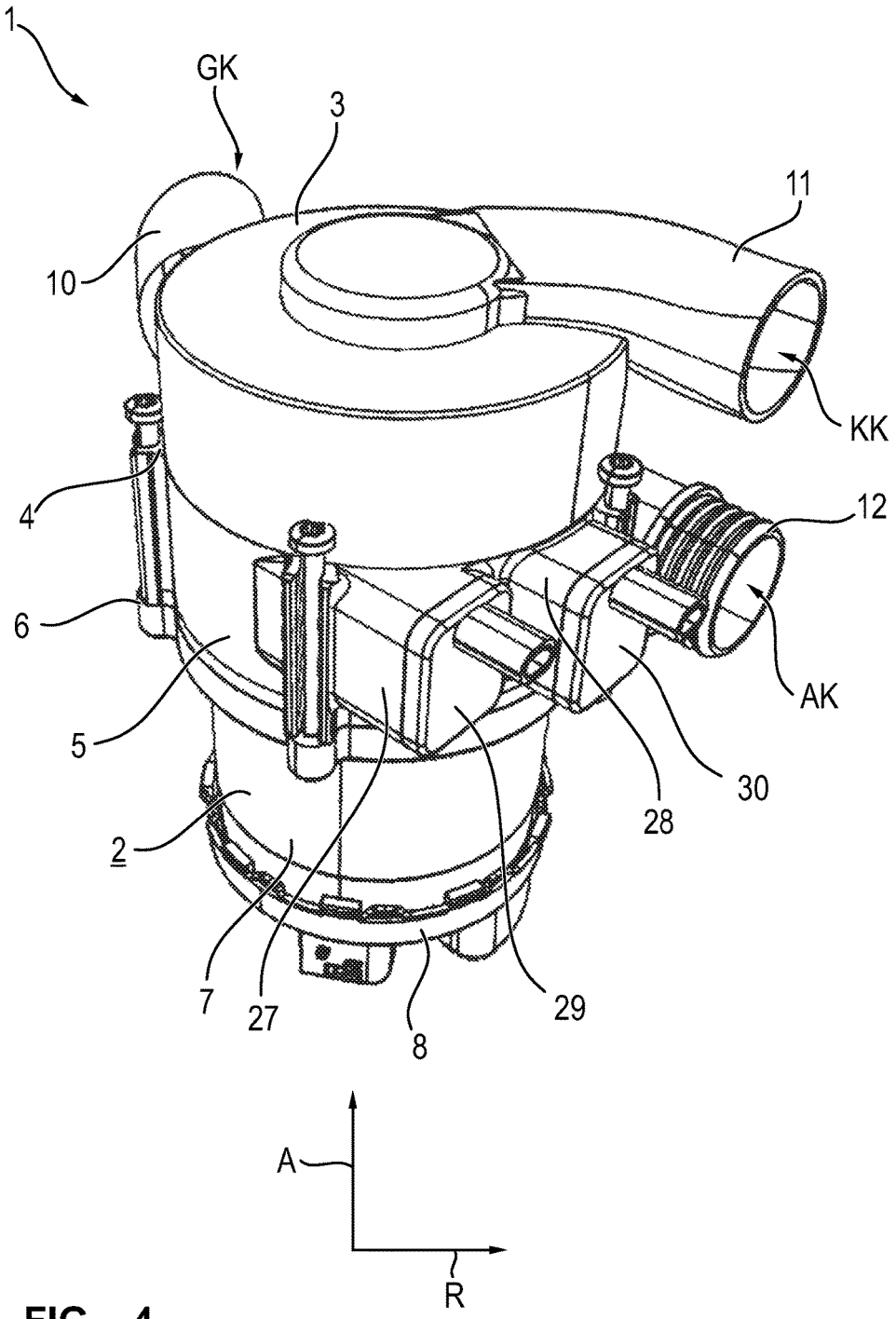
FIG. 4 is a perspective view of one variant of the coolant pump.

Referring now in detail to the figures of the drawings, in which mutually corresponding parts are provided with identical reference numerals, and first, particularly, to FIGS. 1, 2 and 4 thereof, there are seen two embodiments of a coolant pump 1 that is operated by an electric motor, including a pump housing 2 that in the exemplary embodiment is embodied in multiple parts. The pump housing 2 includes a pump cover 3 and an intermediate housing part 5 that is connected to the pump cover by way of a flange connection 4 and for its part is connected by way of a flange connection 6 to a motor housing 7. The intermediate housing part 5 forms a component of the pump housing 2, so that the intermediate housing part 5 is also referred to below as a housing section. An electronics housing 8 is allocated on a base side to a motor housing 7 and the electronics housing can be an integral or separate component of the motor housing 7. Mounting brackets 9 that are formed in one piece on the motor housing 7 are used so as to screw fasten the coolant pump 1 in an engine compartment of a motor vehicle. An intake connecting piece 10 and a bypass flow connecting piece 11 are formed as one piece on the pump cover 3, whereas an outflow or pressure connecting piece 12 is formed as one piece on the intermediate housing part 5. The connecting pieces 10, 11 form suction-side intake ducts GK, KK from a large cooling circuit (cooling element circuit) or from a small bypass flow circuit or cooling circuit (FIG.10), whereas the pressure connecting piece 12 forms a pressure-side outflow duct AK. The axial direction and the radial direction of the water pump 1 are respectively indicated by the letters A and R.

Figure 3:
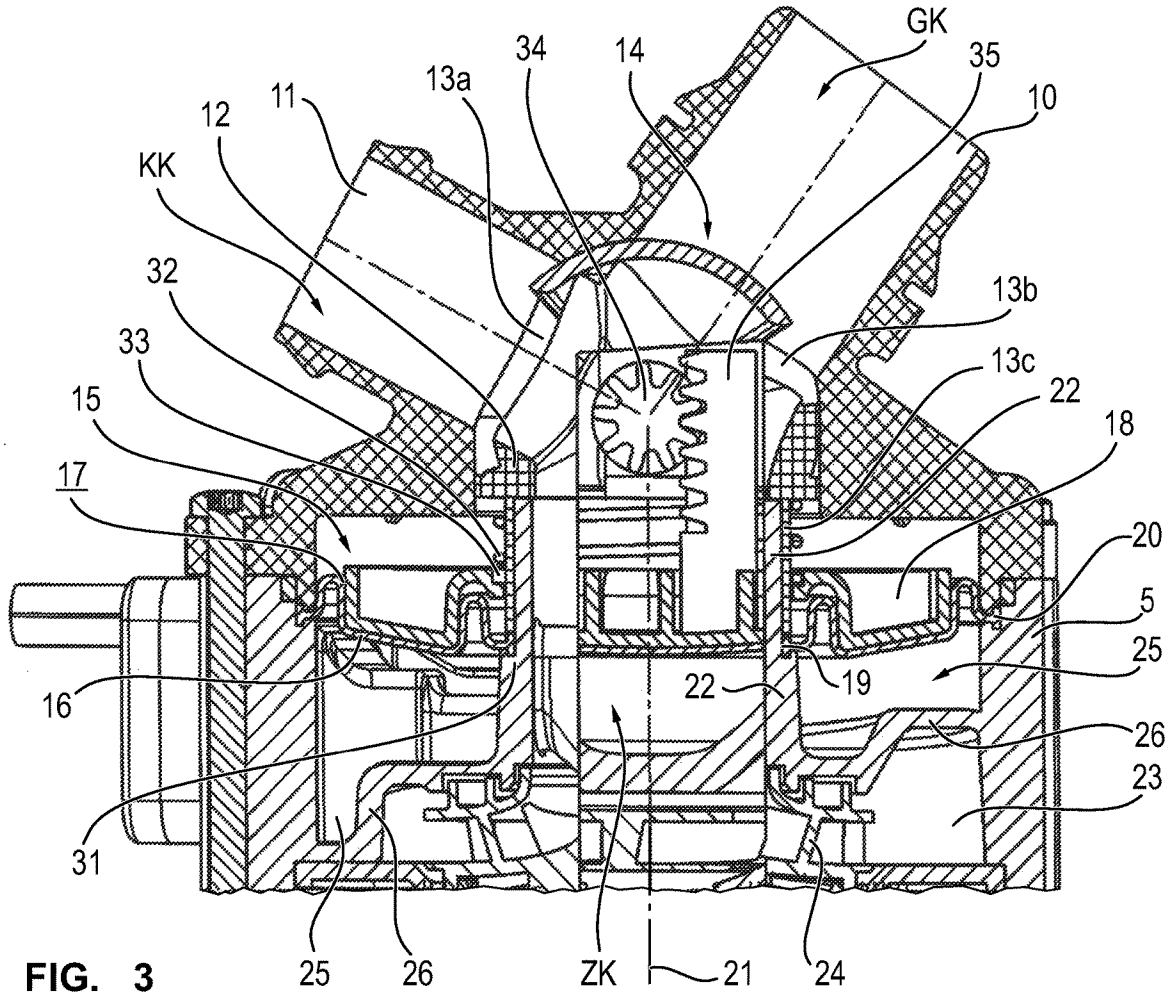
FIG. 3 is a longitudinal-sectional view of the coolant pump in accordance with FIGS. 1 and 2 in a partial view above the electric motor.

In the case of the embodiment in accordance with FIGS. 1 to 3, the intake connecting piece 10 and the bypass flow connecting piece 11 merge with one another approximately in the shape of a letter Y. A ball head-shaped housing dome 13 is provided in a transition region between the intake ducts GK, KK that merge with one another and issue into the connecting pieces 10 or 11, the housing dome having a (first) through-flow opening 13*a*, which is flush with the bypass flow connecting piece 11, and a (second) through-flow opening 13*b*, which is flush with the intake connecting piece 10, and also a cylindrical housing shaft 13*c*.

A control element 14 in the form of a helmet visor-type control flap is pivotably mounted on the ball head-shaped housing dome 13 and the control flap closes the through-flow opening 13*b* and thus the intake duct GK, with the through-flow opening 13*b* being flush with the intake connecting piece 10 in the illustrations in accordance with FIGS. 1 and 2. The housing dome 13 closes the intake connecting piece 10 and the bypass flow connecting piece 11 inside the housing with respect to a suction-side pressure chamber 15 that is formed in the axial direction A below the pump cover 3. A flexible, elastic diaphragm 16 closes the suction-side pressure chamber 15. For this purpose, the diaphragm 16 that is embodied in an annular shaped manner and extends in the radial direction R is inserted into the pump housing 2 on the outer periphery-side between the housing cover 3 and the intermediate housing part 5 and is fixedly clamped by using the flange connection 4.

The diaphragm 16 is part of an annular piston-type control actuator 17 that is disposed in such a manner that it can move axially, in other words in the axial direction A, inside the housing in the region of the intermediate housing part 5 that forms the housing section. The control actuator 17 includes as a further component a reciprocating or working piston 18, that is referred to below as a control piston and that is likewise embodied in an annular shaped manner and extends over the cross-section of the intermediate housing part 5 and thus over the cross-section of the pump housing 2. The sealing configuration of the control piston 18 and thus of the control actuator 17 in the pump housing 2 is provided by using the diaphragm 16. This or the control actuator 17 separates the suction side of the coolant pump 1 from its pressure side, in that the diaphragm 16 extends on the lower side of the control piston 18 that is remote from the suction-side pressure chamber 15, the diaphragm supports the control piston and seals the control actuator 17 with respect to the pump housing 2 in the region of the housing section 5.

As is evident in connection with FIG. 3, the diaphragm 16 is joined centrally in the housing and in the outer edge region to the control piston 18 in a form-locking manner to form a labyrinth-type inner and outer sealing region 19 or 20. In addition or as an alternative thereto, a material connection or force-locking connection can also be advantageous. The control piston 18 of the control actuator 17 is guided on the outer side in such a manner as to be able to displace in the axial direction A on a central cylindrical housing periphery 22 that is coaxial with respect to the pump or motor axle 21. The sealing configuration with respect to this housing periphery 22 is performed by using the inner sealing region 19 of the diaphragm 16. The housing periphery 22 that is a formed part of the intermediate housing part 5 forms a central inflow duct ZK that leads to a pressure-side pump chamber 23, which is embodied as a helical duct, and a pump impeller 24 of the coolant pump 1 is disposed in the pump chamber. Thus, the control actuator 17 separates the suction side from the pressure side of the coolant pump 1. An actuator chamber 25 is formed between the control actuator 17 and the pump chamber 23, downstream from the intermediate housing part 5 as a hydraulic working chamber inside the housing section. As will be further explained with reference to FIGS. 7 to 9, the actuator chamber 25 is connected to the pump chamber 23.

Figure 7:
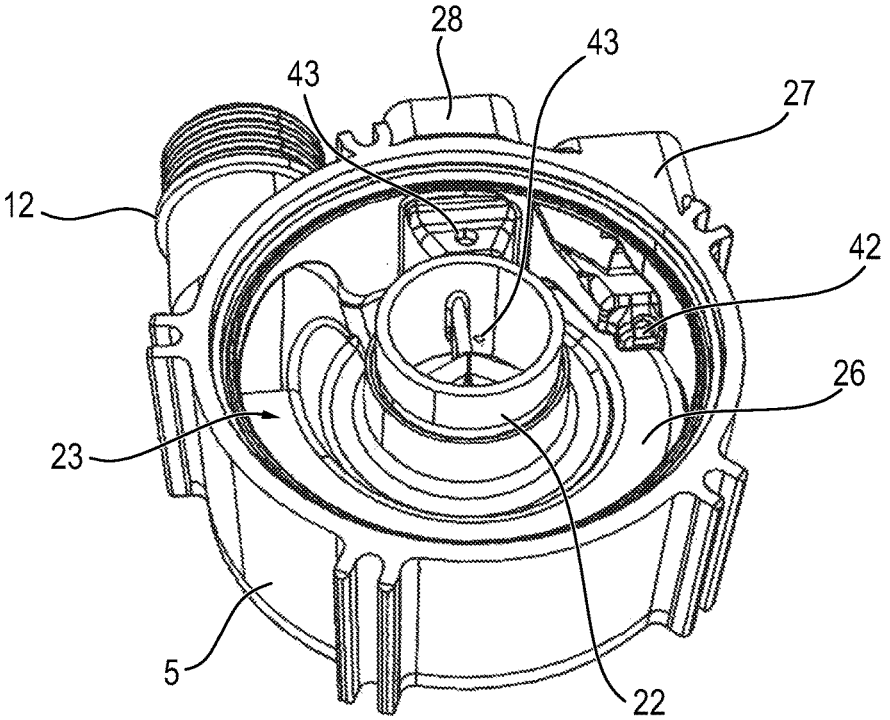
FIGS. 7 and 8 are perspective views of an intermediate housing part of the coolant pump with a view into a pump or actuator chamber.
Figure 8:
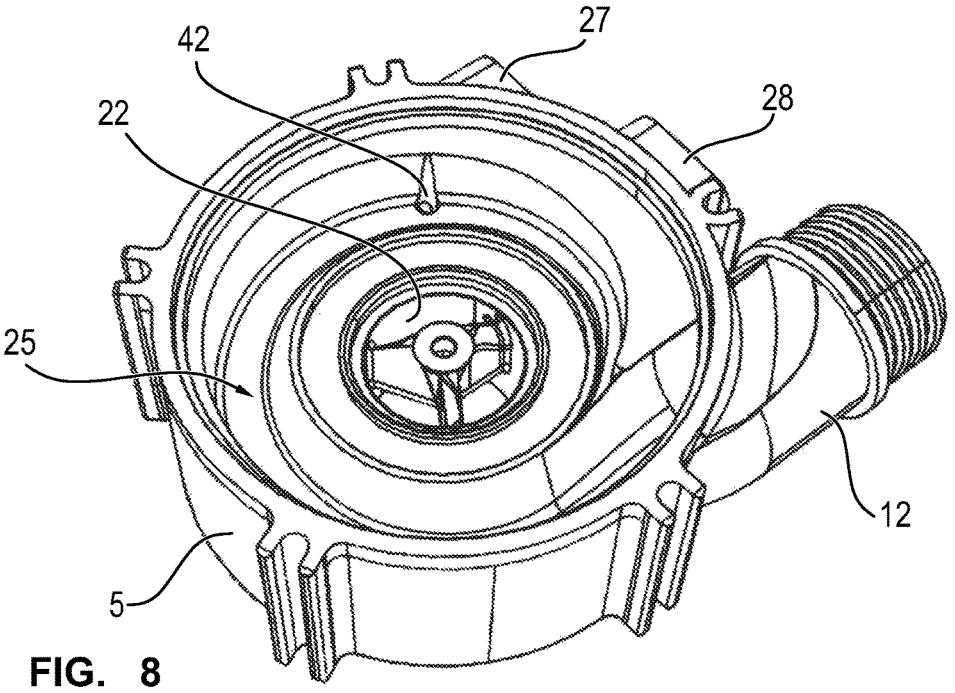

The pump impeller 24 that is disposed inside the pump housing 2 in a coaxial manner with respect to the central pump or motor axle 21 is driven so as to rotate by using the electric motor. The helical-shaped pump chamber 23 is formed by correspondingly shaped housing contours and is separated from the actuator chamber 25 by using a radial housing wall 26 that is a component of the intermediate housing part 5 and formed therein inside the housing (FIGS. 7 and 8). The pump chamber 23 issues into the tangentially extending pressure connecting piece 12.

In the peripheral direction of the pump housing 2 adjacent the pressure connecting piece 12, two housing or connection shafts 27, 28 for receiving electronically controllable control valves (solenoid valves) 29 or 30 are formed as one piece on the intermediate housing part 5. The configuration of the valves 29, 30 in the intermediate housing part 5 and their suction-side and/or pressure-side integration is evident in FIGS. 7 to 9.

As is illustrated in FIG. 3, the cylindrical housing periphery 22 is formed as one piece on the intermediate housing part 5 in a coaxial manner with respect to the motor or pump axle 21 so as to form the central inflow duct ZK inside the housing. This cylindrical housing periphery 22 extends from above the pump impeller 24 and thus from the pressure side by way of the control actuator 17 to the suction side of the coolant pump 1. At this site, the cylindrical shaft 13*c* of the ball head-shaped housing section 13 encompasses the central cylindrical housing section 22 in a collar-like manner. The sealing region 19 of the diaphragm 16 is inserted on the inner edge side and fixedly clamped at this site between the cylindrical shaft 13*c* and a shoulder contour 31 of the central housing section 22 of the intermediate housing part 5.

A helical spring 32 as a restoring element is located between the cylindrical shaft 13*c* of the housing dome 13 and the cylindrical housing section 22 in a coaxial manner with respect to the collar-like shaft connection. The restoring spring 32 lies against the control piston 18 of the control actuator 17 and supports itself inside the housing on the ball head-shaped housing part 13*c*. A spring end of the restoring spring 32, which is allocated to the control actuator 17, lies in an annular groove 33 of the control piston 18.

The control element 14 that is embodied as a control flap is coupled to a corresponding toothed rack 35 by way of a pinion 34 that is provided with the control element in the region of the pivot axis and the toothed rack is in turn coupled to the control actuator 17 and for this purpose is formed as one piece on the control piston 18. By virtue of the fact that the control piston 18 is coupled in this manner to the pinion 34, which moves the control flap, by way of the axially extending toothed rack 35, a stroke movement of the control actuator 17 in the axial direction A causes the control element 14 to pivot between two positions. When the control element 14 is in a first flap position, the through-flow opening 13*b* of the ball head-shaped housing part 13 is closed and consequently the intake connecting piece 10 and the inflow duct GK are closed, whereas the other through-flow opening 13*a* and consequently the bypass flow connecting piece 11, in other words the other inflow duct KK, is completely open. When the control element is in the other (second) flap position, the intake connecting piece 10 is open, whereas the bypass flow connecting piece 11 is closed. Whereas the FIGS. 1 and 2 illustrate the closed position of the intake connecting piece 10 and thus the opened bypass flow connecting piece 11, FIG. 3 illustrates an intermediate position of the control flap 14.

Figure 5:
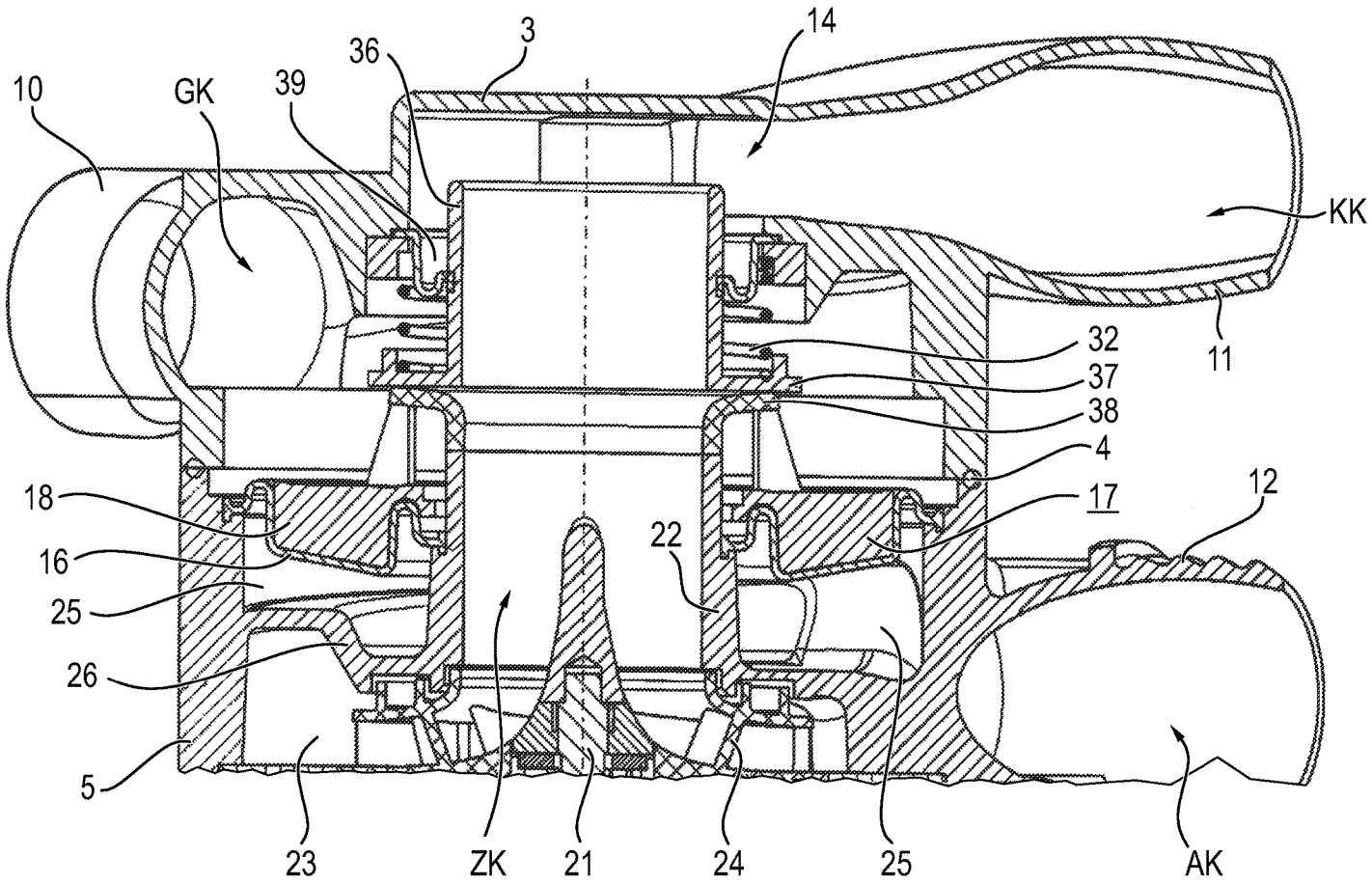
FIGS. 5 and 6 are partial views of the coolant pump in accordance with FIG. 4 in the longitudinal-sectional view with the control actuator in the idle position or in stroke position (working position) as the coolant pump is started up.
Figure 6:
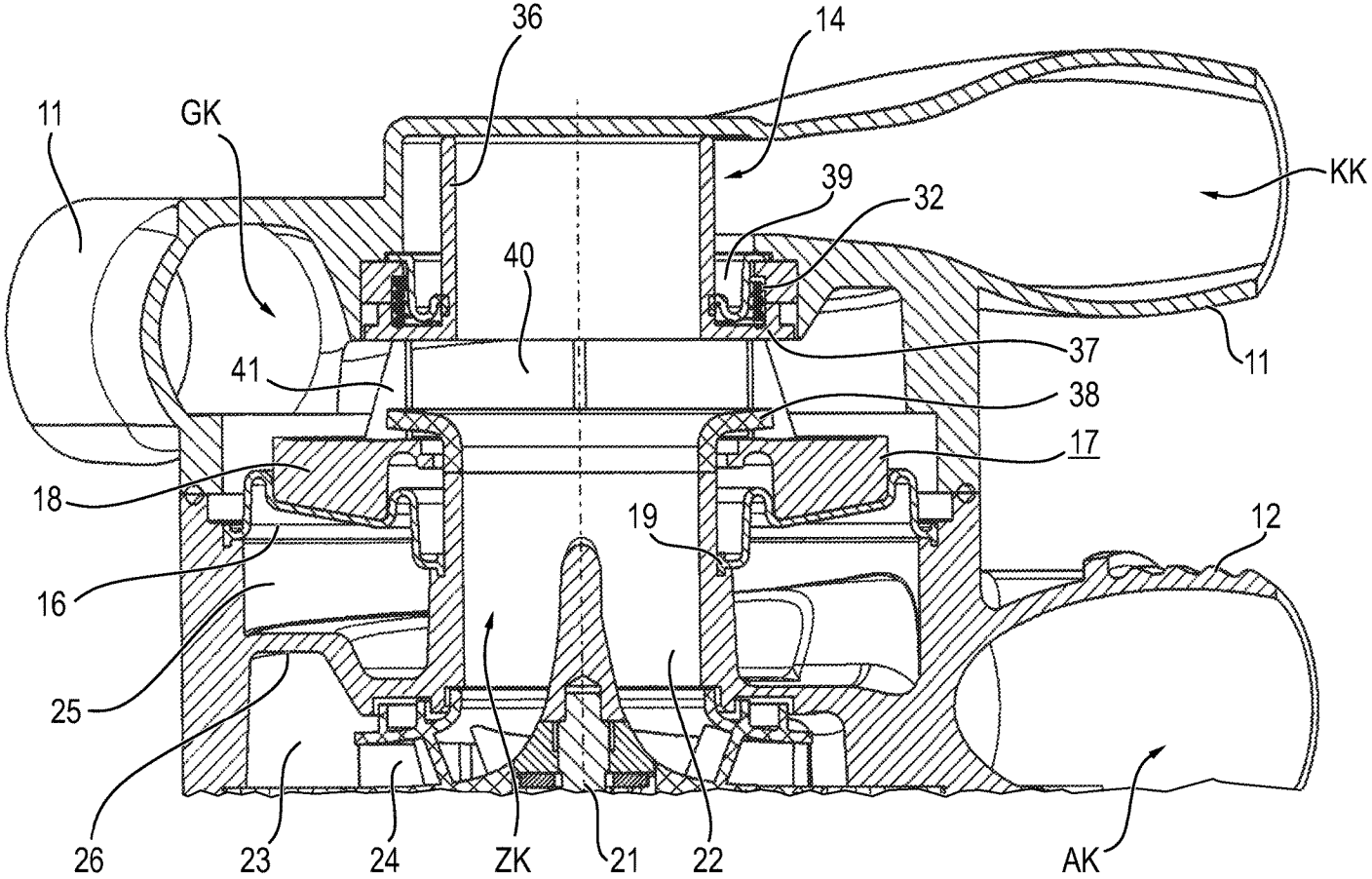

In the case of the embodiment in accordance with FIGS. 4 to 6, the intake connecting piece 10 and the bypass flow connecting piece 11 extend in a tangential manner. It is evident in FIG. 5 that the pump impeller 24 that is driven by using the electric motor so as to rotate is disposed inside the pump housing 2 in turn in a coaxial manner with respect to the central pump or motor axle 21. The helical-shaped pump chamber 23 that issues into the pressure connecting piece 12 is in turn separated from the actuator chamber 25 by using the housing wall 26 of the intermediate housing part 5. In comparison, FIG. 4 clearly illustrates the housing or connection shafts 27, 28 for receiving the control valves (solenoid valves) 29 or 30 formed as one piece adjacent the pressure connecting piece 12 on the intermediate housing part 5. The construction of the intermediate housing part 5 including the integration of the housing shafts 27, 28 for the valves 29, 30 corresponds in turn to the constructions illustrated in FIGS. 7 to 9.

This preferred embodiment differs from the embodiments illustrated in FIGS. 1 to 3 by virtue of the control element 14 being constructed as an annular slider in the form of a cylindrical control sleeve 36 that is disposed in an axial manner above the likewise cylindrical housing periphery 22 of the intermediate housing part 5, and at that site the cylindrical control sleeve is quasi in the form of an axial extension or protrusion of the cylindrical housing periphery 22 of the intermediate housing part 5 and lies flush with the housing periphery 22. The mutually facing cylinder ends or cylinder annular edges of the control sleeve 36 and of the housing periphery 22 are bent (bent at right angles) outwards to form circumferential annular collars or collar contours 37 or 38. The control sleeve 36 is sealed on the cover side by using an annular seal or annular diaphragm 39. The restoring spring 32 is located between this and the control sleeve-side collar 37.

FIG. 5 illustrates the control element 24 that is embodied as an annular slider in the idle or starting position (initial position) in which the central inflow duct ZK that extends by way of the control sleeve 36 is connected to the intake duct KK of the small cooling circuit, with the intake duct being formed by the bypass flow connecting piece 11, whereas the other intake duct GK of the large cooling circuit is closed in turn by using the control element 14.

In contrast, FIG. 6 illustrates the position of the control element 14 that is embodied as an annular slider in the other control position (operating position) showing the bypass flow connecting piece 11 that is closed by using the control sleeve 36 and thus the closed small intake circuit KK, whereas the intake duct GK that is part of the large cooling circuit and is formed or represented by the intake connecting piece 10 is connected to the central inflow duct ZK so as to form a flow gap 40 between the control sleeve 36 and the housing periphery 22. The switchover from the small circuit by way of the intake duct KK to the large cooling circuit by way of the intake duct GK is performed in turn in response to the control actuator 17 being hydraulically actuated as a result of the coolant pump 1 being started up and the pressure difference that is produced as a consequence between the suction side and the pressure side of the control actuator 17. The control actuator 17 is hydraulically actuated by way of the hydraulic connection, illustrated with reference to FIGS. 7 and 8, between the pump chamber 23 and the actuator chamber 25. The control actuator 17 consequently separates the pressure side, which is represented by the pump chamber 23 and the actuator chamber 25, from the suction side in the region of the respective issuing site of the intake ducts KK and GK in the central inflow duct ZK (cover side).

The control actuator 17 is coupled to the control element 14 in this embodiment in a rigid manner and the coupling is produced by using the axial connecting support pieces 41 between the control piston 18 and the control sleeve 36 that forms the annular slider. It is evident when comparing FIGS. 5 and 6 that the control actuator 17 together with the rigidly connected control sleeve 36 as an annular slider in the operating position (FIG. 6) has fully performed a stroke in the axial direction A, with the stroke corresponding to the axial width of the flow gap 40.

Figure 9:
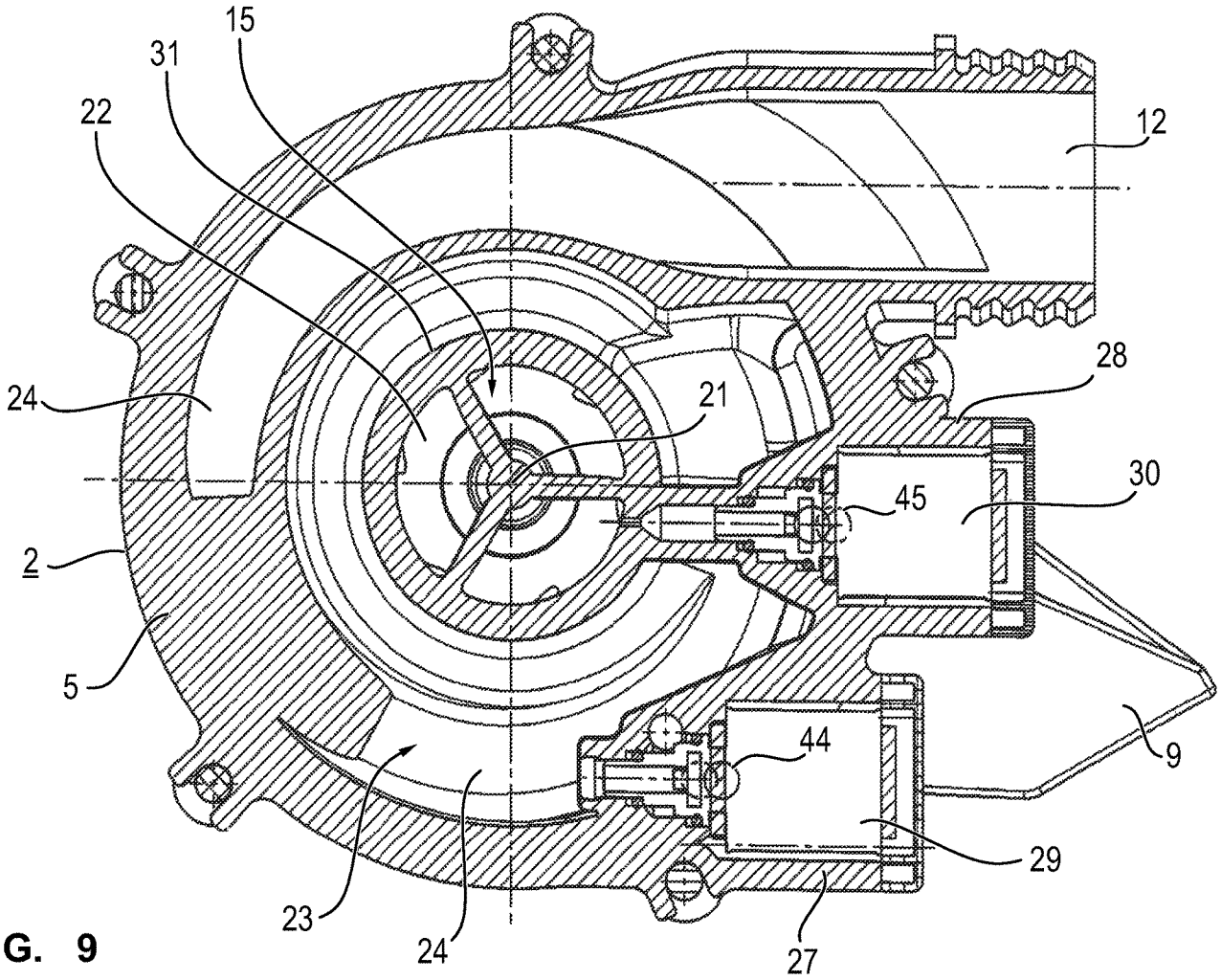
FIG. 9 is a cross-sectional view of the intermediate housing part with a view of two control valves.

FIGS. 7 and 8 illustrate the intermediate housing part 5 separately with a view into the pump chamber 23 or into the actuator chamber 25 that is lying opposite, whereas FIG. 9 illustrates in a cross-sectional view of the intermediate housing part 5, the configuration of the valves 29, 30 in the housing shafts 27 or 29. FIG. 8 illustrates a (first) pressure opening 42 that is provided in the otherwise closed housing wall 26 of the intermediate housing part 5, the pressure opening connecting the pump chamber 23 to the actuator chamber 25 and issuing into the chamber, as is evident in FIG. 7. The control actuator 17 is hydraulically actuated by way of this (first) pressure opening 42 that can be closed in a controlled manner by using the valve 29.

As is evident in FIG. 7, a further (second) pressure opening 43 is provided that is incorporated in the central housing periphery 22 of the intermediate housing part 5 and issues by way of the housing shaft 28 of the further (second) control valve 30 into the pump chamber 25. The pressure difference between the suction side and the pressure side of the coolant pump 1 is compensated by way of this second pressure opening 43 in that this second pressure opening 23 connects the inlet and outlet side of the pump impeller 24 in the flow direction of the coolant KM (FIG. 10), by way of the inflow duct ZK and the pump impeller 25, the pump impeller rotating in the pump chamber 23. By virtue of opening the second pressure opening 43 that is fundamentally closed, in other words is closed in the idle or starting position (FIG. 5), the extent to which the hydraulic pressure influences the control actuator 17 is reduced, so that as a result of the restoring force of the spring 32 the control actuator 17 is returned into the starting position illustrated in FIG. 5 by the control cylinder 36 lying against the central housing periphery 22 or remains in this position as the coolant pump 1 is started up and during the operation of the coolant pump 1.

The (first) control valve 29 that is effective as a controllable control valve is open in the non-energized state. This is illustrated in FIG. 9 by using a valve ball 44 that is indicated as a closed circular line and the position that the valve ball is in when the control valve 29 is being controlled and is thus open is illustrated by the broken line. The control process in response to the control valve 29 being energized causes the first pressure opening 42 to close and consequently for pressure to build up in the actuator chamber 25. Depending upon the position of the control actuator 17, it is displaced in the axial direction and as a result the control element 14 is adjusted or such an adjustment is also inhibited if the water pump 1 is operating, as will be explained below.

The second control valve 30 that is effective as a restoring valve is closed in the non-energized state, which is illustrated in turn in FIG. 9 by virtue of its valve ball 45 in the continuous line illustration. Since this control valve 30 is controlled, it causes the second pressure opening 43 (valve ball 45 illustrated by the broken line) to open and consequently a pressure compensation occurs between the pressure side and the suction side of the coolant pump 1. The (second) control valve 30 can be preferably used merely for an emergency actuation in the event that the first control valve 29 in the non-energized state does not return to its closed position.

Figure 10:
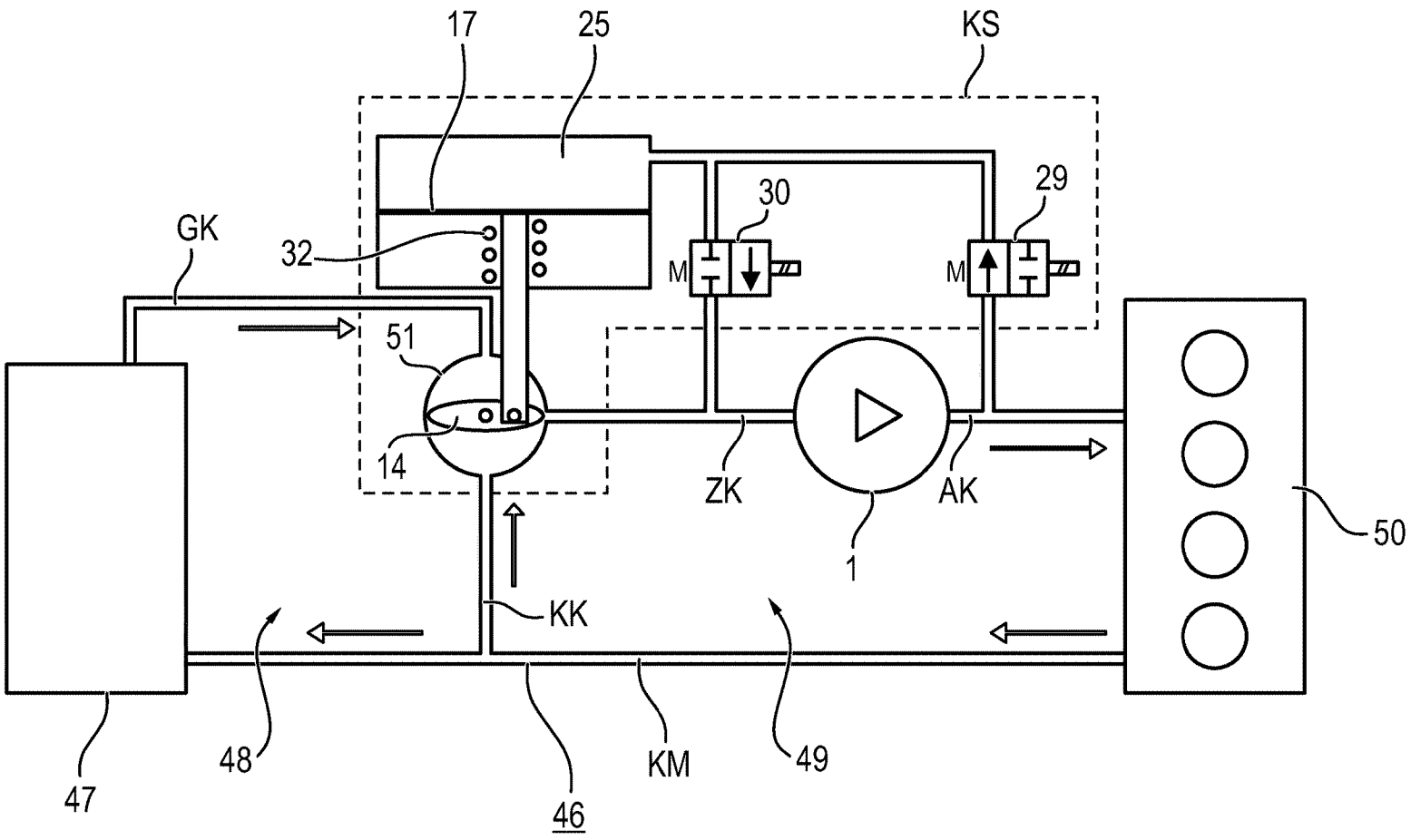
FIG. 10 is a schematic and block diagram showing the integration of the electrical coolant pump having a coolant controlling function in a coolant circulation of an internal combustion engine of a motor vehicle.

FIG. 10 illustrates in a schematic view, an exemplary configuration of circulations of a thermo management system of a motor vehicle engine having such a coolant pump 1. The electrical coolant pump 1, in other words the coolant pump that is driven by an electric motor, is integrated in a coolant circuit 46. This includes a cooling element circuit 48 as a large cooling circuit, which extends by way of a cooling element (heat exchanger) 47, and a bypass flow circuit (bypass circuit) 49 as a small circuit. The bypass flow circuit 49 extends, by bypassing the cooling element 47, directly by way of the coolant circulation 1 and a cylinder block 50 that represents an internal combustion engine (combustion engine) of a motor vehicle which is not further illustrated.

FIG. 10 also illustrates the intake ducts KK, GK and the suction-side inflow duct ZK and the pressure-side outflow duct AK. Furthermore, FIG. 10 also illustrates as functional elements the control actuator 17 including the restoring spring 32, the control element 14 in a mixing chamber 51, which represents the cover-side pressure chamber of the pump housing, the actuator chamber 25 and the pressure-side and suction-side control valves 29 or 30, wherein the functional elements represent the control device KS of the coolant pump 1 as a coolant controller. The embodiments illustrated in FIGS. 1 to 9 represent two variants of a complete integration of these functional elements of the coolant controller that are illustrated in FIG. 10 and consequently a corresponding coolant pump 1 with an integrated control device KS, the variants being different with respect to the control principle of the control element 14.

The electrical coolant pump 1 having an integrated control device KS conveys the coolant KM, in particular cooling water, that is drawn in by the internal combustion engine or its cylinder head 50 in the large cooling element circuit 48 by way of the cooling element 47, back to the cylinder head 50 and circulates this coolant KM. Moreover, by bypassing the cooling element 47, the coolant pump 1 conveys the coolant KM that is circulating in the small bypass flow circuit 49. In so doing, it is possible by using the controllable control actuator 17 to mix comparatively cool coolant KM of the large cooling element circuit 48 with comparatively hot coolant KM of the small bypass flow circuit 49 by appropriately adjusting the control element 14.

The control actuator 17 is connected upstream in the starting position by using the restoring spring 32 in such a manner that the intake duct GK is closed and the intake duct KK is open. The restoring spring 32 is not pre-stressed in this case. The coolant pump 1 that is incorporated in the coolant circuit 46 in this starting position holds the small cooling circuit 49 open by bypassing the cooling element 47. If the coolant pump 1 is started up, then the control actuator 17 is hydraulically actuated as a result of the pressure build-up caused by the operation. As a result of it being coupled to the control element 14, the intake duct KK is closed and the intake duct GK is opened. Consequently, a switchover occurs from the small cooling circuit (bypass flow circuit) 49 to the large cooling circuit 48 and the coolant KM is guided through the cooling element 47. The hydraulic pressure, which is required for this, and consequently the control energy for the control actuator 17 is itself generated by the electrical coolant pump 1 itself so that it is not necessary to provide a separate additional drive for actuating the control actuator 17.

In order to control the position of the control element 14 during the operation of the coolant pump 1, the electromagnetic control valve 29 is provided, which in the normal operation is open in the non-energized state. By virtue of controlling this control valve 29 it is rendered possible as soon as the coolant pump 1 is started up to maintain the starting position of the coolant pump 1 with the open small cooling circuit 49 in that pressure is prevented from building up in the actuator chamber 25 to a sufficient level at which the control actuator 17 is hydraulically actuated. It is also rendered possible by virtue of controlling this control valve 29 that an excess pressure in the actuator chamber 25 is reduced so that the coolant pump 1 can close the large cooling circuit 48 completely or in part and/or can open the small cooling circuit 49 in a controlled manner. The restoring valve 30 that is controlled in an inverse manner to the control valve 29 can be controlled in a similar manner to the control valve 29 so as to control the influence of pressure on the control actuator 17 and thus so as to open and close the intake ducts GK, KK or the connecting pieces 10, 11 in a controlled manner.

The invention is not limited to the above-described exemplary embodiment. On the contrary, other variants of the invention can also be derived therefrom by the person skilled in the art without departing from the subject of the invention. In particular, moreover all individual features that are described in connection with the exemplary embodiment can also be combined with one another in any manner without departing from the subject.

It is thus possible to embody the coolant pump 1 by way of example also without the control valves 29, 30 and as an alternative thereto as required to switch off the control valves so as to cause a switchover from the large cooling circuit to the small cooling circuit. It is also possible to set the travel or adjust the travel, in other words the stroke or axial stroke of the control actuator 17 by virtue of correspondingly controlling the rotational speed of the coolant pump 1, as a consequence of which the hydraulic pressure at the control actuator 17 is changed.

In addition, the control piston 18 can be embodied practically as a diaphragm cover or can be sealed by using an elastic sealing lip in the pump housing 2. In any case, the control piston 18 of the control actuator 17 can be constructed in such a manner that, even in the event of a malfunction of the diaphragm 16 and loss of control at the control piston 18, the coolant pump 1 can actuate the control element 14 accordingly, in particular in the case of a high load, so as to open the large cooling circuit 48. Moreover, the control actuator 17 can only include the diaphragm 16, if necessary with support elements or the like.

The invention claimed is:

1. An electrically motorized coolant pump, comprising:

a suction side having two suction-side intake ducts and a pressure side having a pressure-side outflow duct for a coolant;

a pump housing having a housing section and a pump chamber;

a pump impeller being driven in said pump chamber;

a control actuator disposed in said housing section between said suction side and said pressure side and hydraulically actuated in response to a demand for coolant;

a control element coupled to said control actuator to open and close said intake ducts;

said control actuator having at least one of a diaphragm disposed in said pump housing in a coolant-tight manner or a control piston, said diaphragm or control piston being connected or coupled to said control element; and said housing section having an actuator chamber connected to said pump chamber by a pressure opening for hydraulically actuating said control actuator.

2. The electrically motorized coolant pump according to claim 1, which further comprises an electrically controllable control valve for closing said pressure opening.

3. The electrically motorized coolant pump according to claim 2, wherein said control valve is open in a non-energized state.

4. The electrically motorized coolant pump according to claim 1, wherein said control actuator is axially displaceable in said housing section of said pump housing.

5. The electrically motorized coolant pump according to claim 1, wherein said housing section includes a central inflow duct issuing on said suction side by way of said control element into said intake ducts and issuing on said pressure side into said pump chamber towards said pump impeller.

6. The electrically motorized coolant pump according to claim 5, wherein said control actuator encompasses said inflow duct in an annular manner and seals said actuator chamber.

7. The electrically motorized coolant pump according to claim 5, which further comprises an electrically controllable control valve, said pump chamber being connected to said inflow duct by another pressure opening to be activated by said electrically controllable control valve.

8. The electrically motorized coolant pump according to claim 7, wherein said electrically controllable control valve is closed in a non-energized state.

9. The electrically motorized coolant pump according to claim 1, which further comprises:

a restoring element connected upstream of said control actuator in a starting position in which a first one of said intake ducts is open and a second one of said intake ducts is closed; and said control element, as a result of a hydraulic actuation of said control actuator, closing said first intake duct against a force of said restoring element and opening said second intake duct.

10. The electrically motorized coolant pump according to claim 1, which further comprises a control gear coupling said control piston to said control element.

11. The electrically motorized coolant pump according to claim 1, which further comprises:

a bypass flow circuit not having a cooling element;

a cooling element circuit of a coolant circulation of a motor vehicle engine;

said pump housing including a pressure connecting piece disposed in a vicinity of said housing section and opening out of said pump chamber;

said pump housing including a bypass flow connecting piece disposed on a cover side and opening into a first one of said intake ducts so as to connect to said bypass flow circuit; and said pump housing including an intake connecting piece opening into a second one of said intake ducts so as to connect to said cooling element circuit.

* * * * *